United States Patent [19]

Thomson

[11] Patent Number: 4,630,761

[45] Date of Patent: Dec. 23, 1986

[54] CONTAINER WITH POURING SPOUT AND REMOVABLE COVER

[75] Inventor: Loronzo H. Thomson, Warner Robins, Ga.

[73] Assignee: Little Rapids Corp., Green Bay, Wis.

[21] Appl. No.: 588,814

[22] Filed: Mar. 12, 1984

[51] Int. Cl.[4] ..... B65D 47/00; B65D 5/72; B65D 41/04; A61B 5/00

[52] U.S. Cl. ..... 222/551; 222/562; 222/572; 220/288; 215/329; 128/760

[58] Field of Search ..... 222/562, 566, 572, 551; 220/288; D9/373, 375, 372, 447; 604/403; 128/760, 767; 215/318, 329

[56] References Cited

U.S. PATENT DOCUMENTS

| | | | |
|---|---|---|---|
| 2,459,073 | 1/1949 | Hamilton | 222/572 X |
| 2,540,931 | 2/1951 | Carvalho | 222/566 |
| 2,640,628 | 6/1953 | Klosky | 222/572 X |
| 3,189,072 | 6/1965 | Starr | 220/288 X |
| 3,700,146 | 10/1972 | Cousins et al. | 222/572 X |
| 4,244,920 | 1/1981 | Manschot et al. | 220/288 X |
| 4,298,129 | 11/1981 | Stull | 215/318 X |

*Primary Examiner*—Joseph J. Rolla
*Assistant Examiner*—Gregory L. Huson
*Attorney, Agent, or Firm*—Roylance, Abrams, Berdo & Goodman

[57] ABSTRACT

A specimen container having a laterally projecting pouring spout and a removable cover retained by screw threads in such fashion that the cover closes both the main container body and the pouring spout, the tip of the pouring spout serving as part of the screw threads.

5 Claims, 16 Drawing Figures

CONTAINER WITH POURING SPOUT AND REMOVABLE COVER

RELATED APPLICATION

A method for making specimen containers of the configuration disclosed herein and labelling the containers to avoid confusion of the specimens is disclosed in my copending application Ser. No. 588,685, now U.S. Pat. No. 4,592,884.

This invention relates to containers with pouring spouts and removable covers and, though of broader applicability, is particularly useful for specimen containers useful, for example, to contain urine specimens.

BACKGROUND OF THE INVENTION

In doctors' offices, analytical laboratories and hospitals it is standard practice to obtain specimens of body fluids, particularly urine, from patients in order to analyze the specimens as an aid to diagnosis. Though the practice of analyzing specimens of urine and other body fluids is very old, handling of the specimens is still done in a crude fashion, with the specimens given by the patient into containers of widely varying types, frequently without covers and frequently without any truly dependable means for assuring identification of the specimen as that of a particular patient. Thus, the specimen is frequently collected in a glass bottle, carried about the office open, and simply placed on a piece of paper bearing the patient's name. In some doctors' offices, an adhesive label is applied to the side of the bottle and the patient's name written on the label. In other cases, a wide mouth container is used, a cover is provided, and the label is applied to the cover. The specimen containers are frequently without pouring spouts. In general, the practices followed in handling specimens in doctors' offices, laboratories and hospitals are unsanitary, because of spillage of portions of the specimens, and dangerous, because of the possibility of confusion resulting from failure adequately to relate the specimen to the correct patient. As a result of such problems there has been a demand for specimen containers which are more sanitary, less subject to spillage and easier to correlate with the patient. While some improvement has been achieved, there has been a continuing need for a container which could be more easily covered and sealed by the patient, would when covered not be subject to spillage, would be readily identifiable as containing a specimen from a particular patient, and would nevertheless be inexpensive.

OBJECTS OF THE INVENTION

A general object of the invention is to provide a container which includes a pouring spout, yet is easily closed and sealed.

Another object is to devise such a container wherein application of the cover, though requiring no unusual manual manipulation, is effective to close both the container proper and the pouring spout.

A further object is to provide such a container which is especially suitable for use as a specimen container and which provides surfaces which make it possible to so mark the container body and cover to better protect against possible failure to correlate the specimen with the patient from which the specimen was taken.

SUMMARY OF THE INVENTION

Containers according to the invention comprise a hollow container body and a removable cover. Typically molded from polymeric material, the body comprises a side wall and a bottom wall, the side wall including an upper end portion and being of such configuration that any transverse cross section of the side wall defines a closed figure, the upper end portion including a pouring spout projecting generally outwardly therefrom, and external retaining rib means including the tip of the pouring spout, the upper end portion of the side wall being normally open and terminating in a upper edge which lies in a plane transverse to the side wall and includes the upper edge of the pouring spout. The cover includes a main wall and dependent securing means joined to the main wall, the dependent securing means including inwardly directed retaining rib means constructed and arranged to mate with the external retaining rib means of the side wall of the container body. The rib means are so located that, when fully mated to secure the cover to the container body, the cover closes the entire upper end portion of the container body including the pouring spout. Thus, while the pouring spout allows the contents of the container to be poured from the container without spillage or dripping, when the cover has been removed, application of the cover prevents escape of liquid even via the pouring spout.

IDENTIFICATION OF THE DRAWINGS

Figure 13:
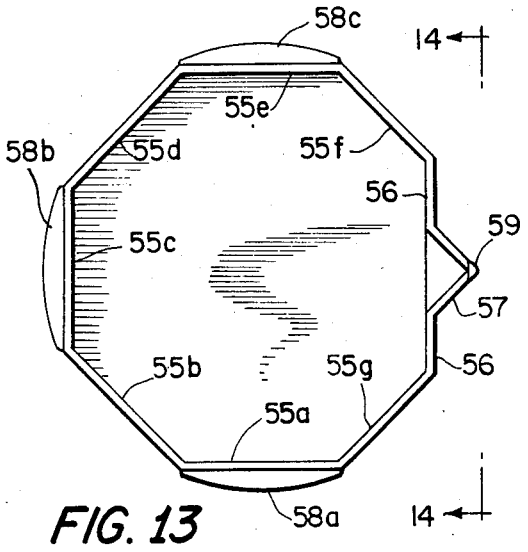
Figure 14:
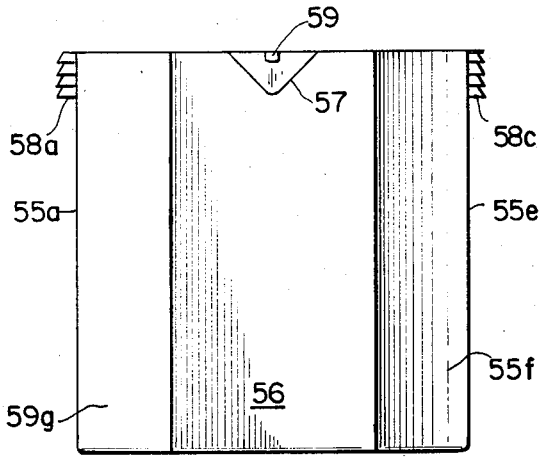
Figure 15:
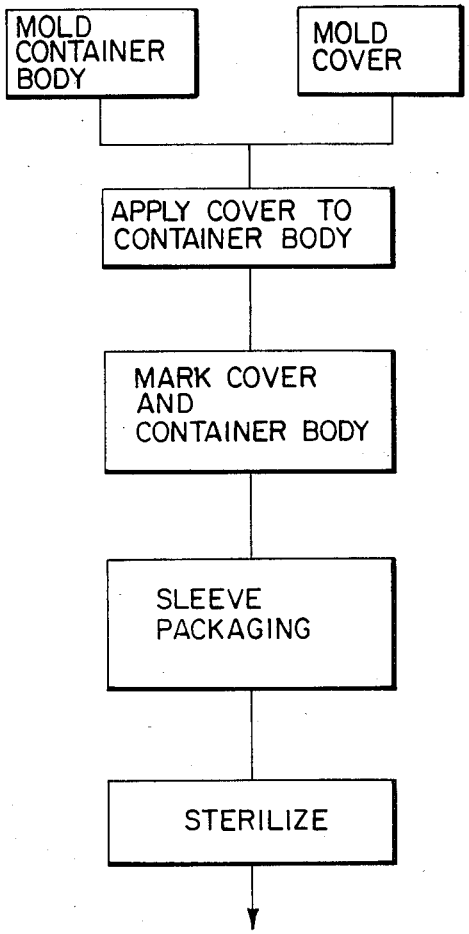
Figure 8:
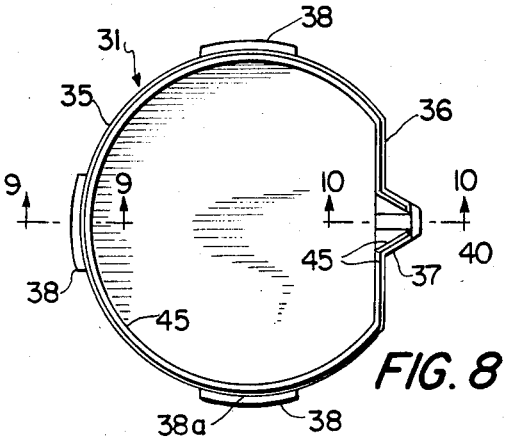
FIG. 8 is a view similar to FIG. 1 of a container body according to another embodiment.
Figure 11:
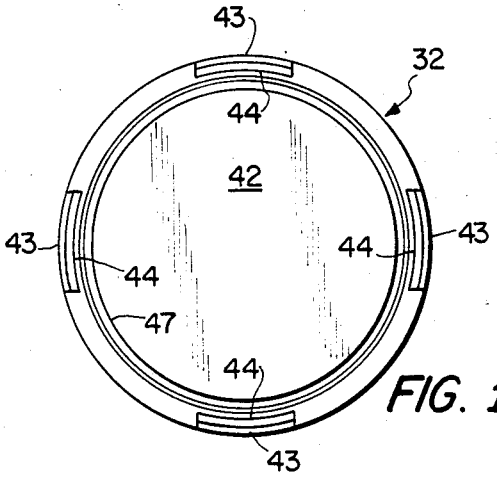
Figure 12:
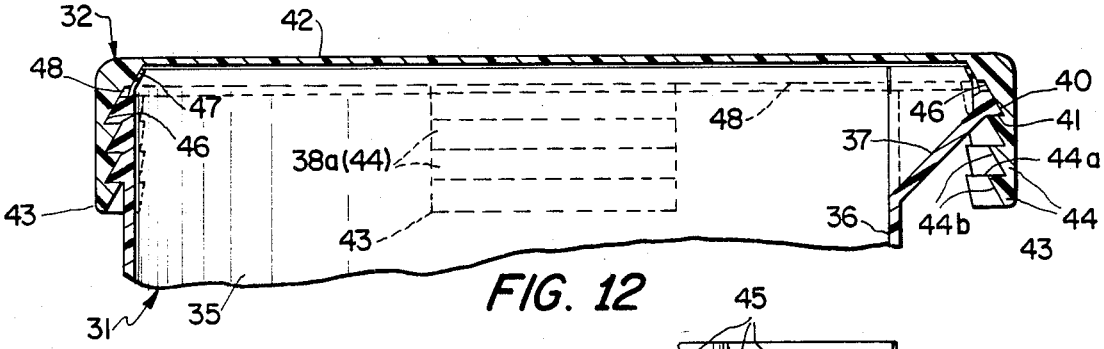
Figure 9:
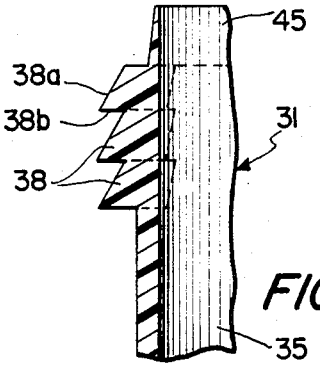
Figure 10:
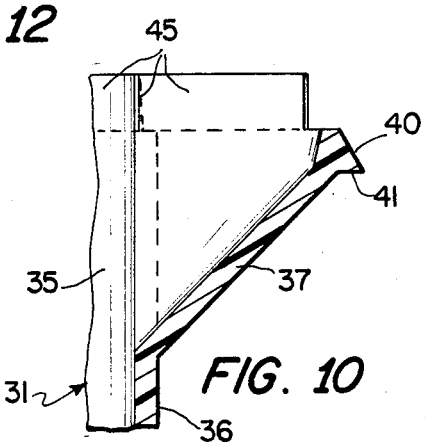

FIGS. 9 and 10 are fragmentary vertical sectional views taken generally on lines 9—9 and 10—10, respectively, FIG. 8 and substantially enlarged relative to FIG. 8;

FIG. 11 is a bottom plan elevational view of the cover for the container body of FIGS. 8–10;

FIG. 12 is a fragmentary vertical sectional view, enlarged relative to FIG. 8, showing the cover of FIG. 11 applied to the container body of FIGS. 8–10;

FIG. 13 is a top plan elevational view of another embodiment of container body to which the cover of FIG. 11 can be applied;

FIG. 14 is a side elevational view, taken generally on lines 14—14, FIG. 13, of the container body of FIG. 13; and FIG. 15 is a flow sheet illustrating the method by which the container bodies and covers are serialized according to the invention.

DETAILED DESCRIPTION OF THE INVENTION

The Embodiment of FIGS. 1-5A

Figure 5:
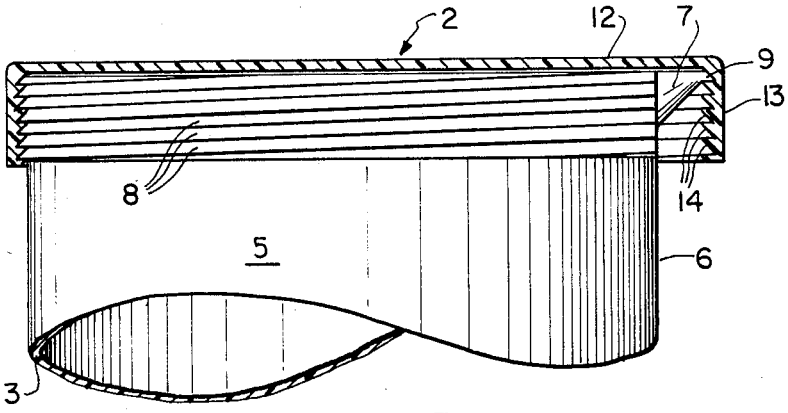
FIG. 5 is a fragmentary view, partly in side elevation and partly in vertical cross section, enlarged with respect to FIGS. 1–4, showing the cover applied to the container body but not fully tightened.
Figure 5A:
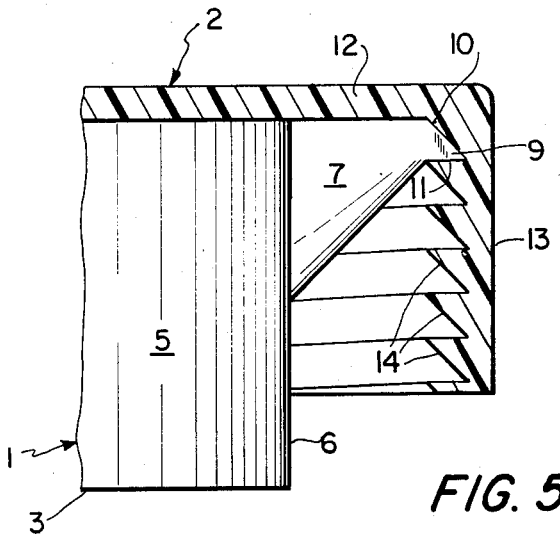
FIG. 5A is a fragmentary view, enlarged with respect to FIG. 5, showing a portion of the cover and upper edge portion of the body after the cover has been rotated to fully applied and sealed position.

FIGS. 1-5A illustrate a urine specimen container according to one particularly advantageous embodiment of the invention and comprising a hollow container body, indicated generally at 1, and removable cover, indicated generally at 2. Body 1 comprises a side wall 3 and a bottom wall 4 and is an integral piece, advantageously formed by injection molding from a relatively rigid thermoplastic polymeric material such as polystyrene. Side wall 3 includes a first portion 5 which is generally right circular cylindrical, save for the draft angle necessary for removal from the mold. The side wall also includes a flat portion 6 which lies in a plane which is chordal with respect to circles centered on the longitudinal axis of body 1, chordal portion 6 extending for the full length of body 1. At the upper end portion of the side wall, portion 6 has an integrally formed pouring spout 7 which opens upwardly, communicates with the interior of the container body, and is generally triangular in top plan elevation and in vertical cross section. The upper end portion of side wall 3 is provided with integrally formed external retaining rib means, in this embodiment having the form of buttress threads 8. Threads 8 are continuous throughout the circular extent of side wall portion 5 but are interrupted by chordal portion 6. Tip 9 of pouring spout 7 has in side elevation a configuration and size matching the cross-sectional shape and size of one turn of threads 8, and the tip is so located as to act as a portion of the threads. Thus, as best seen in FIG. 5A, tip 9 has an upper face 10 inclined downwardly and outwardly at the same angle as are the upwardly directed flanks of threads 8. Tip 9 also has a lower face 11 which is generally horizontal when the container is upright, and the dimensions of the tip are such that the tip, in effect, constitutes a segment of one turn of the buttress threads 8.

Cover 2 is also formed as an integral piece, as by injection molding, from a thermoplastic polymeric material (typically polypropylene) having significant resilient flexibility. The cover includes a flat circular main wall 12 and a dependent right circular cylindrical skirt 13, the skirt having internal threads 14 of size and configuration to mate with threads 8. The diameter of threads 14 is such that threads 14 will mate with the combination of threads 8 and spout tip 9. The resilient flexibility of the cover is such that, when the cover is centered on body 1 and pushed downwardly against the body, skirt 13 is outwardly deformed resiliently and the female buttress threads of the cover pass over the male threads of the container body until, as seen in FIG. 5, the lower face of main wall 12 of the cover is immediately adjacent the upper edge of side wall 3 of the container body. The threads are fully mated by a small rotation of the cover relative to the container body, the action of the threads forcing the lower face of main wall 12 into flush contact with the upper edge of side wall 3, as seen in FIG. 5A. Considering FIGS. 2 and 3, it will be noted that the upper edge of the side wall of the container body, including the upper edge of the pouring spout, lies in a plane transverse to the longitudinal axis of the container body, so that final mating of threads 8 and 14 results in flush contact of the main wall of the cover with the entire upper edge of the container body. Thus, simply pushing the cover into place, followed by tightening through a partial turn of the cover relative to the container body, closes both the container proper and the pouring spout against escape of liquid. As an added advantage, inclined surface 10 of the tip of the pouring spout, intersecting face 11 in a sharp corner, renders the pouring spout substantially drip free.

Figure 3:
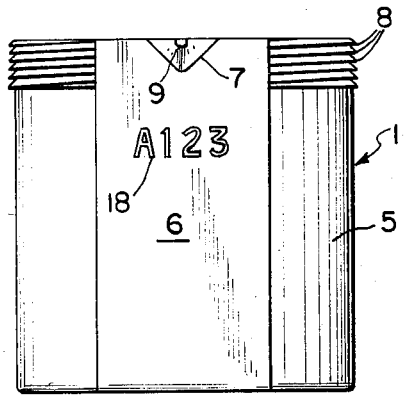
FIG. 3 is a side elevational view taken generally on line 3—3, FIG. 2.

The upper face of main wall 12 of the cover is provided with both a patient identification, as by making an elongated rectangular area 15 of that surface frosted so as to accept handwriting with a felt tip pen or other writing instrument, and with a permanent serial number 16, the serial number being parallel to the length of rectangular area 15 and applied in any conventional fashion, as by hot stamping or use of a permanent adhesive label. Simultaneously with application of serial number 16, a reference mark 17 is also applied to the upper face of wall 12 near the periphery of the cover, mark 17 being angularly displaced from serial number 16 by a distance and in a direction such that, when cover 2 is pushed into place while mark 17 is centered above pouring spout 7 and then turned to complete tightening of the screw threads, serial number 16 will be approximately centered with respect to side wall portion 6. A second serial number 18 is permanently applied to side wall portion 6 in a location centered on and spaced a substantial distance below pouring spout 7, as seen in FIG. 3. Then, whenever the cover has been properly applied to the container body, even a quick glance is adequate to determine that the cover, bearing the patient's name in addition to the serial number, matches the container body, and confusion between specimens from two different patients as a result of inadvertent interchange of the covers is avoided.

Figure 6:
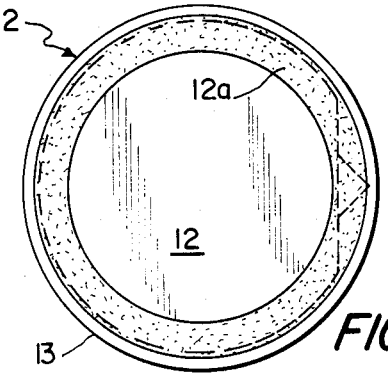
FIG. 6 is a bottom plan elevational view of the cover of FIG. 4 when the cover is provided with a seal ring for engagement with the upper edge of the side wall of the container body.

Improved sealing between the cover and the upper edge of the side wall of the container body can be achieved by applying to the bottom surface of wall 12 of the cover a sealing ring 12*a*, FIG. 6, the sealing ring covering the peripheral portion of the bottom surface of main wall 12 and having a radial width such that, when the cover has been applied to the container body, the sealing ring will always engage all of the upper edge of the side wall 5, chordal portion 6 and the upper edge of the pouring spout regardless of the rotational position of the cover on body 1, one location of the upper edge relative to the sealing ring being shown in broken lines in FIG. 6. Sealing ring 12*a* can be of any conventional resiliently compressible sealing material, either as a separate ring permanently adhered to wall 12, or as a coating applied to wall 12.

Figure 1:
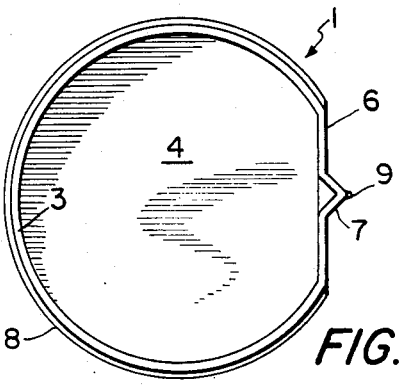
FIG. 1 is a top plan elevational view of a container body according to the invention.
Figure 4:
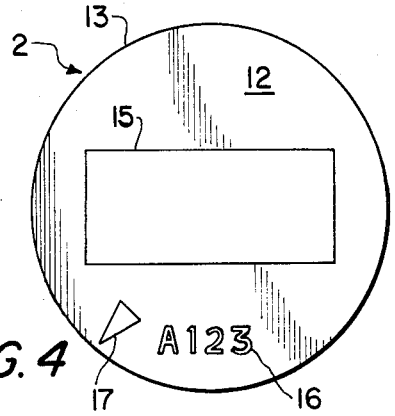
FIG. 4 is a top plan elevational view of the cover for the container body of FIGS. 1–3.
Figure 2:
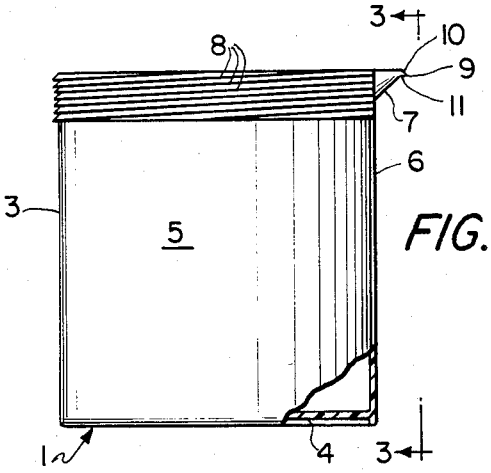
FIG. 2 is a side elevational view of the container body with a portion broken away for clarity of illustration.
Figure 7:
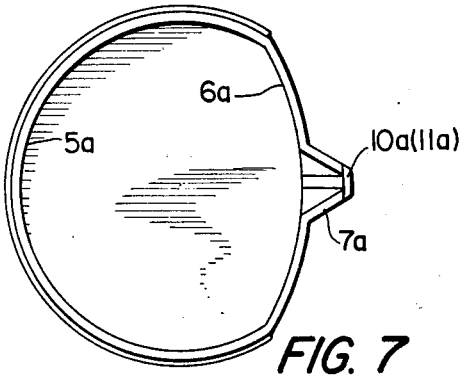
FIG. 7 is a view similar to FIG. 1 but illustrating a modified form of the container body of FIGS. 1–3.

Though it is advantageous to employ a flat generally chordal portion, as at 6, FIGS. 1-3, and a sharply triangular pouring spout, the generally chordal side wall portion can be of curved transverse cross section and the tip of the pouring spout can be widened to provide a larger thread segment. Thus, in the modification shown in FIG. 7, side wall portion 6*a* is of arcuate transverse cross section, with a radius of curvature centered on a diameter of the main side wall portion 5*a* but substantially greater than the radius of curvature of main side wall portion 5*a*. In top plan, pouring spout 7*a* is less tapered than spout 7, so that surfaces 10*a* and 11*a* are longer and constitute a larger thread segment.

The Embodiment of FIGS. 8–12

Though it is advantageous to employ as the retaining rib means screw threads having a significant pitch so that the cover can be snapped into place, then urged more firmly against the upper edge of the container by tightening the screw threads, the invention can be practiced with retaining rib means presenting no pitch, so that tightening by relative rotation between the cover and body is unnecessary. Thus, as seen in FIGS. 8–12, container body 31 can include a main side wall portion 35 in the form of a portion of a right circular cylinder and a generally chordal flat side wall portion 36. Portions 35 and 36 present upper edge portions lying in a common plane transverse to the central axis of the container body. As seen by comparison of FIGS. 8 and 10, pouring spout 37 is integral with the side wall of the container body, projects outwardly from chordal portion 36, and includes a tip which is arcuate, centered on the central axis of the body, and includes downwardly and outwardly slanting upper face 40 and a flat lower face 41 which lies in a plane transverse to the axis of the container body. Formed integrally with the upper end portion of the side wall of the container body are three groups of outwardly projecting retaining ribs 38 which are, in radial cross section, similar to buttress threads but have no pitch. Thus, as seen in FIG. 9, each rib 38 has a downwardly and outwardly slanting upper face 38*a* and a flat lower face 38*b*, lower faces 38*b* being mutually parallel and lying in planes transverse to the axis of the container body, the uppermost ones of ribs 38 being transversely aligned with the tip of the pouring spout so that lower face 41 of the pouring spout lies in the same transverse plane as do the lower faces 38*b* of the uppermost ones of ribs 38.

In this embodiment, body 31 is molded as an integral piece from a thermoplastic polymeric material which, while having adequate rigidity to perform as a container body, has significant resilient deformability. Integral with the upper edge of the container body and the pouring spout is a thin upwardly projecting sealing lip 45 of triangular radial cross section. Lip 45 includes a portion which extends circularly along the upper edge of side wall portion 35, two portions which extend in straight line fashion along the portions of the upper edge of side wall portion 36 and which are respectively at the opposite sides of the pouring spout, and two portions which are straight and extend along the upper edges of the pouring spout, stopping short of upper face 40 of the spout tip. Lip 45 is slit at two points, each at the junction of one of the side walls of the pouring spout with side wall portion 36. As seen in FIG. 9, lip 45 is thin at its juncture with the side wall of the container body and still thinner at its upper edge, the inner surface of the lip lying in the same plane as the inner surface of the corresponding portion of the body side wall, the outer surface of the lip slanting upwardly and inwardly at a small angle.

As seen in FIGS. 11 and 12, cover 32 is formed as an integral piece from thermoplastic polymeric material and includes a flat main wall portion 42 of circular plan form and four dependent securing tabs 43 which are circumferentially short and spaced equally about the outer periphery of the cover. The circumferential spacing between tabs 43 and the circumferential length of the tabs are such that, when the cover is properly applied to the container body, each tab 43 can coact with a different one of the groups of retaining ribs 38 and the tip of the pouring spout. Each tab 43 has integrally formed inwardly projecting arcuate retaining ribs 44 of size and configuration to mate with external retaining ribs 38 of the container body. Thus, each internal retaining rib 44 has, as seen in FIG. 12, a flat upper face 44*a* which is transverse with respect to the central axis of the cover and a lower face 44*b* which lies in an upwardly and inwardly tapering frustoconical plane, and the arrangement is such that, with cover 32 disposed with tabs 43 in general axial alignment respectively with a different one of the three retaining rib groups 38 and the tip of the pouring spout, pushing cover 32 against the upper end of the container body causes the internal ribs of tabs 43 to ride over the external ribs 38 of the container body until each upper face 44*a* of the internal ribs 44 is engaged beneath one of the external ribs and face 41 of the tip of the pouring spout.

As seen in FIG. 12, tabs 43 depend from the peripheral portion of the cover. The outer surfaces 43*a* of the tabs all lie in a common right circular cylindrical plane concentric with the central axis of the cover. The inner surfaces of the tabs include the faces of internal ribs 44 and, above the uppermost rib 44, surfaces 46 all of which lie in a common conical plane which tapers upwardly and inwardly at an angle equal to the angle of taper of the uppermost external rib 38, surface 46 having an axial width substantially greater than that of the uppermost one of ribs 38. Cover 32 also includes an annular lip-actuating shoulder 47 which extends in plan to conform generally to sealing lip 45. At its lower end, shoulder 47 joins surface 46 via a downwardly facing shoulder 48. At its upper end, shoulder 47 joins the lower face of main wall 42. Shoulder 47 tapers inwardly and upwardly at an angle greater than the angle at which the outer surface of sealing lip 45 tapers. Hence, when the cover has been applied to the container body, with the cover occupying the proper rotational position relative to spout 37, final mating of the inwardly directed retaining ribs 44 of the cover with the outwardly directed retaining ribs 38 of the container body holds the cover in the position seen in FIG. 12, so that shoulder 47 deforms sealing lip 45 inwardly, throughout the length of the sealing lip, and the outer surface of the sealing lip is maintained in sealing engagement with shoulder 47 as a result of resilient deformation of the sealing lip. Since the sealing lip is deformed inwardly, the slits in the sealing rib at the junctures between the chordal side wall portion and the pouring spout are substantially closed.

The Embodiment of FIGS. 13 and 14

It is advantageous for the main side wall portion of the container body to be of right circular cylindrical configuration, but a side wall having an upper end portion of polygonal transverse cross section can be employed, as shown in FIGS. 13 and 14. Here, container body 51 includes a main side wall portion 55 the transverse cross section of which is a major portion of an octagon, and a flat side wall portion 56. Portion 55 includes identical flat portions 55*a*–55*e* and two flat portions 55*f* and 55*g*. Portions 55*f* and 55*g* are mutually identical but significantly narrower than are portions 55*a*–55*e*. Portion 56 is flat and of a width significantly wider than that of portions 55*a*–55*e*. Portions 55*b*, 55*d*, 55*f* and 55*g* are flat and of uniform thickness throughout the entire height of the container body. Portions 55*a*, 55*c* and 55*e* are flat and of uniform thickness throughout most of the height of the container body but, in the upper end portion of the body, have integral outwardly projecting male thread segments 58*a*, 58*c* and 58*e*, respectively, the thread segments being centered upon the central longitudinal axis of the container body and thus extending along a common circle. Side wall portion 56 is chordal with respect to the circle along which thread segments 58*a*, 58*c* and 58*e* extend.

Pouring spout 57 projects outwardly in triangular fashion from the upper end portion of side wall portion 56 and terminates in a tip 59 which lies on the same circle in which the thread segments extend and itself constitutes a male thread segment. The container body shown in FIGS. 13 and 14 can be employed in conjunction with the cover shown in FIG. 2, applied as described with reference to FIGS. 5 and 5A. The cover is provided with a label, a marker and a serial number, as described with reference to FIG. 2, and side wall portion 56 of the container body is provided with a serial number 66, FIG. 14, identical with that carried by the cover.

The Method Shown in FIG. 15

The flow sheet of FIG. 15 illustrates one particularly advantageous method for producing containers according to the invention and will be described with reference to production of the container shown in FIGS. 1-5A. Container body 1 and cover 2 are formed in separate molds by injection molding from polystyrene crystal, with the mold for cover 2 constructed to provide frosted area 15 conventionally. The containers and covers are separately delivered to station A where each cover is applied to a container body, with application being such that, with the cover applied and threads tightened, the long dimension of frosted area 15 is parallel to chordal wall portion 6 of the container body. Thus assembled, each container is delivered to station B where serial number 16 and reference mark 17 are applied to the upper surface of wall 12 of the cover, with serial number 16 centered over spout 7 and and mark 17 displaced angularly from the serial number by that distance equal to the rotation of the cover necessary to tighten the threads 8, 14 when the cover has been forced down upon the container body, to bring the threads into engagement, when mark 17 is centered on spout 7. Serial number 16 and mark 17 are applied to cover 2 simultaneously and, simultaneously with such application, serial number 18 is applied to the outer surface of wall portion 6 in a location centered on and spaced below spout 7, spacing of the serial number below the spout being sufficient to allow serial numbers 16 and 18 to be viewed simultaneously. The container, with cover remaining in place, is then packaged in a sleeve of polymeric film conventionally, at station C, then delivered to station D and subjected to conventional in-package sterilization.

What is claimed is:

1. In a container, the combination of an integral hollow container body having a side wall and a bottom wall, the side wall having an upper end portion and a bottom end portion and being of such configuration that any transverse cross section of the side wall defines a closed figure, the bottom end portion of the side wall joining the bottom wall and being closed thereby, the upper end portion of the side wall comprising external rib means including portions which lie generally on a circle which is generally transverse to the container body, a portion of the side wall extending generally as a chord with respect to said circle, the upper end portion of the side wall terminating in an upper edge lying in a plane transverse to the container body, said portion of the side wall having an upper edge which forms part of said upper edge of the side wall and is interrupted by an outwardly projecting pouring spout having an upper edge which is coplanar with said upper edge of the side wall, the pouring spout being of generally triangular transverse cross section and terminating in a tip lying on said circle, said tip being formed to constitute a portion of said rib means; and a detachable cover including a main wall and dependent securing means joined to the main wall, the main wall of the cover being of such size and shape as to be capable of simultaneously engaging the upper edge of the side wall and the upper edge of the pouring spout, the dependent securing means including inwardly directed retaining rib means constructed and arranged to mate with the external retaining rib means of the container body and the tip of the pouring spout, the external retaining rib means, the tip of the pouring spout, and the inwardly directed retaining rib means being so located that, when the rib means are fully mated, the main wall of the cover engages both the upper edge of the side wall of the container body and the upper edge of the pouring spout and thus closes the entire container including the pouring spout.

2. The combination defined by claim 1, wherein said portion of the side wall is flat and the remainder of the side wall is generally cylindrical.

3. The combination defined by claim 1, wherein said portion of the side wall is of arcuate transverse cross section, the remainder of the side wall is generally cylindrical, and said portion of the side wall has a radius of curvature greater than that of said circle.

4. The combination defined by claim 1, wherein the transverse cross section of the side wall is polygonal and said portion of the side wall constitutes one side of the polygon of the cross section.

5. The combination defined by claim 1, wherein the external rib means, including the tip of the pouring spout, and the inwardly directed retaining rib means constitute screw threads.

* * * * *